US007043184B2

(12) United States Patent
Kagawa et al.

(10) Patent No.: US 7,043,184 B2
(45) Date of Patent: May 9, 2006

(54) HEATING DEVICE, FIXING DEVICE, IMAGE FORMING APPARATUS AND HEATING METHOD

(75) Inventors: Toshiaki Kagawa, Kitakatsuragi-gun (JP); Shogo Yokota, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 47 days.

(21) Appl. No.: 10/775,852

(22) Filed: Feb. 9, 2004

(65) Prior Publication Data

US 2004/0156661 A1 Aug. 12, 2004

(30) Foreign Application Priority Data

Feb. 10, 2003 (JP) ..... 2003-032900

(51) Int. Cl.
*G03G 15/20* (2006.01)

(52) U.S. Cl. ..... 399/328; 219/216

(58) Field of Classification Search ..... 399/328, 399/320; 219/216
See application file for complete search history.

(56) References Cited

U.S. PATENT DOCUMENTS 6,445,902 B1 * 9/2002 Hirst et al. ..... 399/328
2003/0063916 A1 * 4/2003 Katayanagi et al. ..... 399/44
2004/0126127 A1 * 7/2004 Fujimori et al. ..... 399/70
2005/0008383 A1 * 1/2005 Tanaka et al. ..... 399/67

FOREIGN PATENT DOCUMENTS

JP 09152807 A * 6/1997
JP 10-162944 6/1998
JP 11352812 A * 12/1999
JP 2000-338818 12/2000

* cited by examiner

*Primary Examiner*—Quana Grainger
(74) *Attorney, Agent, or Firm*—Edwards Angell Palmer & Dodge LLP; George W. Neuner

(57) ABSTRACT

A heating device of the present invention includes a fixing roller and a pressure roller placed in press contact with each other in a press contact region, wherein a recording material having formed thereon an unfixed toner image is heated (fixed) by passing through the press contact region, and is arranged so as to include a heat generating layer formed on the pressure roller, which generates heat by the induction heating, and an induction heating coil unit for heating the heat generating layer by the induction heating, which is formed so as to cover a part of an outer surface of the pressure roller. The heating device of the present invention having the foregoing structure permits the object to be heated in a short period time and shows excellent properties in terms of the saving of energy and the suppression of noise sound.

22 Claims, 12 Drawing Sheets

HEATING DEVICE, FIXING DEVICE, IMAGE FORMING APPARATUS AND HEATING METHOD

This Nonprovisional application claims priority under 35 U.S.C. § 119(a) on Patent Applications Nos. 2003-032900 filed in Japan on Feb. 10, 2003, the entire contents of which are hereby incorporated by reference.

FIELD OF THE INVENTION

The present invention relates to a heating device that is suited, for example, as a heating device in a dry type eletrophotographic apparatus, a drying device in a wet type electrophotographic apparatus, a drying device in an ink-jet printer, a rewritable media erasing device and the like.

BACKGROUND OF THE INVENTION

As one of typical heating devices, a fixing device for use in an electrophotographic printing device such as a copying machine, a printer, etc., is arranged so as to fix a toner image by applying heat and pressure using a pair of rollers (a fixing roller and a pressure roller) which are disposed so as to press one another (heat roller fixing system). Namely, the fixing roller on the side facing the toner image is heated to a predetermined temperature (fixing temperature) by heating means such as a halogen heater, etc., provided inside the fixing roller.

In recent years, as disclosed in Japanese unexamined patent application 2000-338818 (Tokukai 2000-338818; published on Dec. 8, 2000), the structure wherein the surface of the pressure roller is externally heated using the external heating means for pressure roller such as an external heat roller, etc., in contact with the pressure roller (external roller heating system) has been proposed. The fixing device that permits a shorter warm-up time offers the effects of reducing power consumption, increasing the speed as well as suppressing the sheet from being curled.

This fixing device will be explained in reference to FIG. 4.

FIG. 4 shows schematic structures of essential parts of a fixing device using a conventional external roller heating system.

As shown in FIG. 4, the fixing device of the external fixing system includes a fixing roller 131, a pressure roller 132, an external heat roller 133, heater lamps 134, 135 and 136, temperature sensors 137, 138 and 139, a cleaning roller 140 and a temperature control circuit (not shown).

The external heat roller 133 serves as external heating means. The heater lamps 134 and 135 serve as a heat supply for the fixing roller 131. The heater lamp 136 serves as a heat supply for the external heat roller 133. The temperature sensors 137 and 138 serve as temperature detection means for detecting the temperatures of the fixing roller 131, and the temperature sensor 139 serves as temperature detection means for detecting the temperatures of the external heat roller 133. The temperature control circuit serves as the temperature control means.

In the following, each of the foregoing parts will be explained in details.

Firstly, the heater lamps 134 and 135 are provided inside the fixing roller 131, and the heater lamp 136 is provided inside the external heat roller 133. Then, when fed with electric current by a temperature control circuit, the heater lamps 134, 135 emit light at the infrared wavelengths with a predetermined heat distribution. As a result, the inner surfaces of the fixing roller 131 and the external heat roller 133 are heated respectively.

The fixing roller 131 is heated to a predetermined temperature (for example, 190° C.) by the heater lamps 134 and 135 to heat the recording sheet P having formed thereon an image of unfixed toner T which passes through a fixing nip section Y of the fixing device.

The heat roller 131 is made up of a core metal 131*a* and a releasing layer 131*b*. This core metal 131*a* forms the main body of the heat roller 131. The releasing layer 131*b* is provided on the outer surface of the core metal 131*a* to prevent the toner T on the recording sheet P from offsetting.

The core metal 131*a* is preferably iron, stainless steel, aluminum, copper, or an alloy of these metals. Specifically, the metal 131*a* is, for example, stainless steel or carbon steel. Here, the core metal 131*a* is iron (STKM) and has a diameter of 40 mm and a thickness of 0.4 mm to reduce thermal capacity.

Here, it is preferable that the releasing layer 131*b* be made of fluororesin, such as PFA (perfluoroalcoxyalkane; a copolymer of tetrafluoroethylene and perfluoroalkylvinylether) or PTFE (polytetrafluoroethylene); silicone rubber; fluororubber; or similar material.

The pressure roller 132 includes a metal core 132*a* with a diameter of 40 mm, made of iron steel, stainless steel, aluminum, etc., and a heat resistant elastic layer 132*b* made of foamed silicone rubber on the outer surface of the metal core 132*a*. On the surface of the heat resistant elastic layer 132*b*, further formed is a releasing layer 132*c* made of fluororesin as in the case of the fixing roller 131. The pressure roller 132 is pressed to the fixing roller 131 by a spring or other pressure member (not shown) with a force of, for example, 274 N. Then, the fixing nip section Y, about 6 mm wide, is formed between the pressure roller 132 and the fixing roller 131.

The external heat roller 133 is heated to a predetermined temperature (200° C., for example,) by the heater lamp 135 (internal heat supply). This external heat roller 133 is provided on the upstream side of the fixing nip section Y, and placed in press contact with the pressure roller 132 with a predetermined press contact force. This external heat roller 133 forms a heating nip section Z (1.5 mm, for example) with the pressure roller 132.

The external heat roller 133 includes a cylindrical metal core material 133*a* made of aluminum with a diameter of 15 mm and a thickness of 1 mm, and a fluorocarbon resin layer made of synthetic resin which shows excellent heat resistance and mold releasing property as a heat resistant releasing layer 133*b* formed on the metal core material 133*a*.

The cleaning roller 140 is provided for removing toner particles, paper particles, etc. from the pressure roller 132, preventing the external heat roller 133 from being contaminated. The cleaning roller 140 is disposed on the upstream side of the heating nip section Z and presses the pressure roller 132 with a predetermined press contact force. Supported at the axis, the cleaning roller 140 is rotated by the rotation of the pressure roller 132. The cleaning roller 140 is a cylindrical core material.

The pressure roller 131 and the external heat roller 133 are provide with thermistors 137 to 139 as temperature detection means on their outer surfaces respectively. These thermistors 137 to 139 are provided for detecting the respective surface temperatures of the pressure roller 131 and the external heat roller 133. Based on the resulting temperature data as detected by the thermistors 137 to 139, the temperature control means (not shown) controls the conducting of current to the heater lamps 134 to 136 respectively, so as to maintain the respective surfaces of the pressure roller 131 and the external heat roller 133 at predetermined temperatures.

After heating the pressure roller 132 to a predetermined temperature (fixing temperature) by the external heat roller 133, an image of the toner T is heated (fixed) with applications of heat and pressure by making the recording sheet P having formed thereon an unfixed image of the toner T through the press contact region Y between the fixing roller 131 and the pressure roller 132.

The foregoing external roller heating system permits thermal energy to be supplied to the recording sheet P aggressively also from the side of the pressure roller 133 unlike the conventional heat roller fixing system.

With the resulting increase in thermal energy applied to the recording sheet P, it is possible to reduce the surface pressure (load) to be applied to the recording sheet P. Particularly, when adopting the external roller heating system to the conventional high speed apparatus (for example, with a copy speed of 25 sheets per minute in cross feeding of A4 size recording sheet) that requires heavy load due to a lack in thermal energy to be applied to the recording sheet P, the effects as achieved with a reduced surface pressure can be appreciated. That is, the fixing roller 131 can be made thinner and smaller, which in turn reduces the thermal capacity of the fixing roller 131, thereby realizing saving of energy with reduced warm-up time.

The fixing device of the external roller heating system, however, has the following problems.

① The heat supply from the external heat roller to the pressure roller is dominated by the heat transfer by conduction at the heating nip section. The heating nit section, however, has a width of at most several mms, and therefore, an efficient heat supply system cannot be ensured with limited heating performances (heating temperatures).

② Ac compared to the conventional heat roller fixing device without the external heat roller, the surface of the pressure roller becomes high, and an amount of heat radiated from the surface of the external heat roller increases, and besides that heat is radiated from the surface of the external of the external heat roller at the same time. Therefore, depending of the structures of the external heat roller (roller diameter, roller thickness, load, control temperature, etc.), an amount of heat radiated from the fixing device increased as compared to the case of adopting the heat roller fixing system, which results in an increase in overall power consumption (reduction in heat efficiency).

③ The respective surface conditions of the external heat roller and the pressure roller change as time passes, and it is therefore difficult to make the external heat roller to be driven by the pressure roller under stable conditions, which results in a problem that a slipping of the external heat roller is liable to occur. On the other hand, in order to ensure smooth rotations of the external heat roller under stable conditions, noise sound is liable to occur by forcing, for example, the gear to drive.

④ The external heat roller is contaminated by toner paper powders, etc., which is liable to cause the sheet to be contaminated. In response, cleaning means such as a cleaning roller, etc., may be provided on the upstream side of the external heating roller. However, by providing the cleaning means, the structure of the fixing device becomes complicated, and in the meantime, heat load, heat radiation occur, resulting in reduced heat efficiency.

SUMMARY OF THE INVENTION

The present invention is achieved in finding a way to solve the foregoing problems, and it is therefore an object of the present invention to provide a heating device which permits a member to be heated (pressure roller) to heat up in a short period of time, which has excellent properties in terms of saving of energy, and suppression of noise sound, and which also prevents a recording material from being contaminated in its application to a fixing device.

In order to realize the foregoing object, a heating device of the present invention, which includes a first heating member and a second heating member disposed in press contact with one another in a press contact region wherein a recording material having formed thereon an unfixed toner image is heated by passing through the press contact region is characterized by including:

an internal heat supply for heating the first heating member; and induction heating means for heating a portion around a surface of the second heating member in contact with a surface of the recording material on an opposite side of the surface having formed thereon a toner image, the induction heating means being provided outside the second heating member.

The heating device is arranged so as to apply heat and pressure to the recording material by making the recording material (recording sheet, for example) pass through the press contact region at which the first heating member and the second heating member are placed in press contact with one another.

The induction heating indicates to heat the object to be heated by joule heat of an induction current generated by applying the current to the object to be heated by electromagnetic conduction.

According to the foregoing structure, the induction current is generated from the second heating member in contact with the surface of the recording material having formed thereon a toner image, and the portion around the surface of the second heating member is heated by the resulting joule heat by the induction heating section.

The foregoing structure wherein heat is generated directly from the second heating member by the induction heating section offers a higher heat efficiency (heat supplying efficiency) and a wider heating area as compared to the heating system in which heat is applied by making the second heating member in contact with an external high temperature member (external heat roller, for example). Namely, the foregoing structure of the present invention permits the second heating member to be heated in a shorter period of time, and offers the effect of reducing electric power consumption (saving of energy) when heating.

In this structure, the first heating member is heated by an internal heat supply, and the second heating member is induction heated. With this structure, it is therefore possible to arrange so as to operate only the internal heat supply of the first heating member in a state where the recording material is not heated, and to control the surface temperature of each heating member according to the operation state of the heating device. Incidentally, by providing the induction heating section outside the second heating member, a simpler structure of the second heating member can be realized as compared to the case of providing the induction heating section inside the second heating member.

Furthermore, according to the induction heating system, the induction heating section itself hardly generates heat unlike the case of adopting the external roller heating system, and a waste power consumption with the radiation from the external heating section can be suppressed, thereby reducing an overall power consumption (saving of energy).

The foregoing structure of the present invention wherein heat is generated directly from the object to be heated (second heating member) by the induction heating section provided outside the second heating member offers an excellent noise sound suppression without generating, for example, a contact sound between the second heating member and the external heat roller.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

Figure 1:
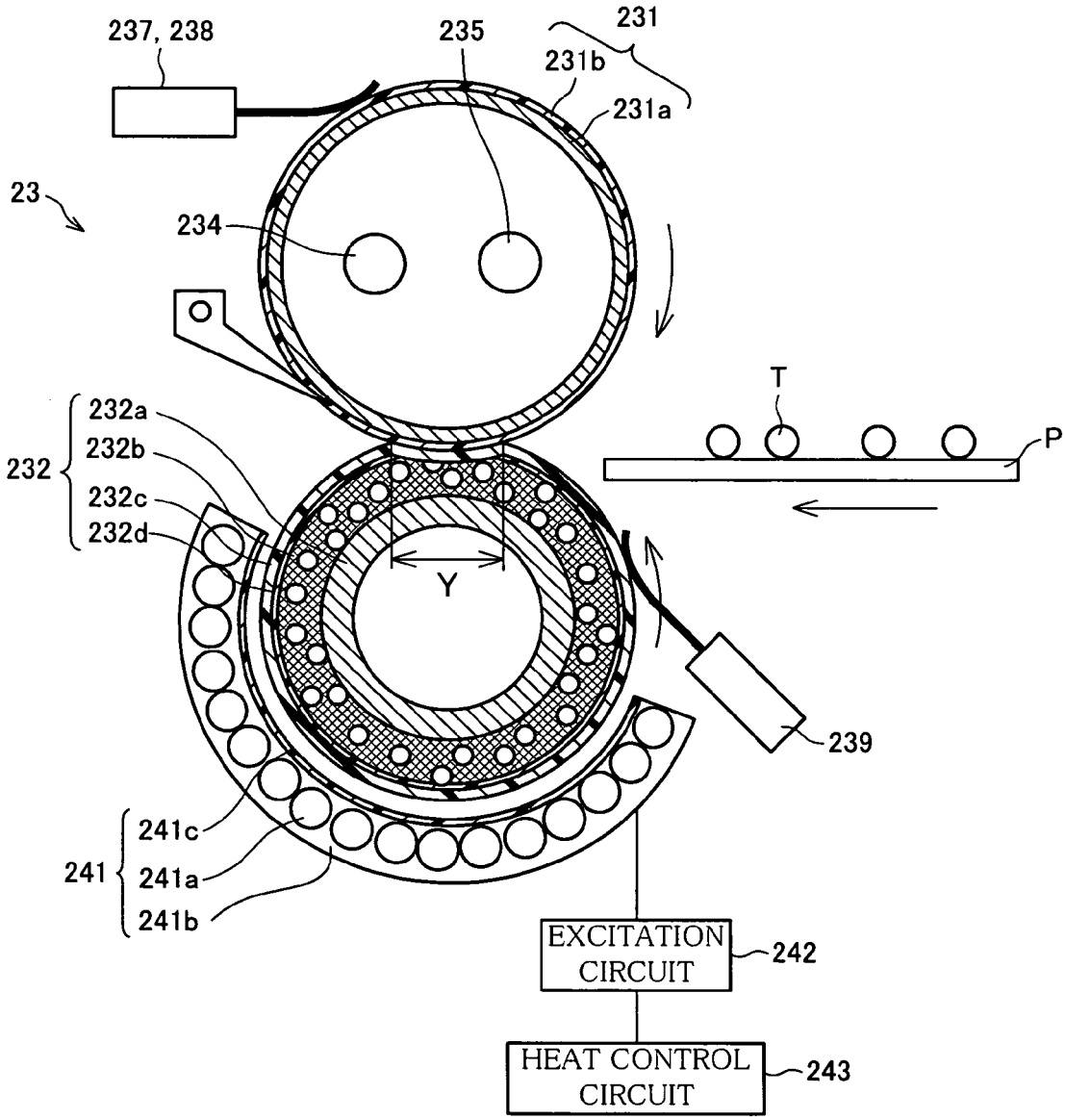
FIG. 1 shows schematic structures of essential parts of a fixing device in accordance with one embodiment of the present invention.
Figure 2:
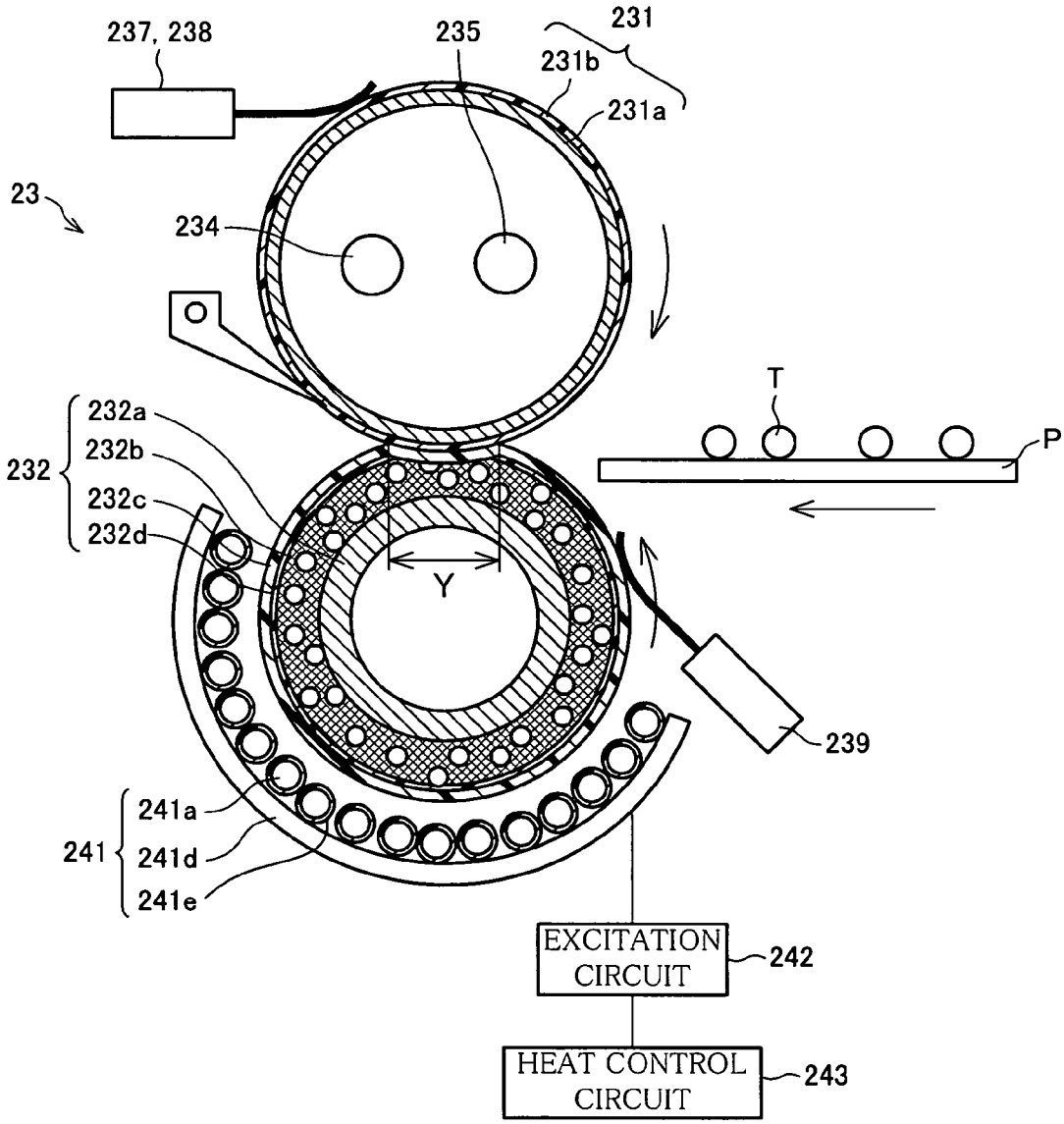
FIG. 2 shows schematic structures of essential parts of a fixing device in accordance with another embodiment of the present invention.

The following will explain one embodiment of the present invention in reference to FIGS. 1 to 12. FIGS. 1 and 2 are cross-sectional views of essential parts of a fixing device (heating device) 23 of the present embodiment.

In reference to figures, an example application wherein the fixing device 23 (see FIG. 8) is adopted in a copying machine will be explained. As to the structures, functions, etc., of the copying machine itself, explanations will be given later.

As illustrated in FIG. 1, the fixing device 23 includes a fixing roller 231 (first heating member), a pressure roller 232 (second heating member), an induction heating coil unit 241 (induction heating means), heater lamps 234, 245, temperature sensors 237, 238 and 239, an excitation circuit 242, a heat control circuit 243 (heat control means) and an induction heating coil drive power supply (not shown).

In the fixing device 23, the recording sheet P (material to be heated) carrying an image of unfixed toner T is transported to pass a press contact region (fixing nip section) Y between the fixing roller 231 and the pressure roller 232 where heat and pressure are applied, thereby fixing the toner T onto the recording sheet P.

Namely, the fixing roller 231 (the first heating member) and the pressure roller 232 (the second heating member) are disposed in press contact with one another with a predetermined pressure in the fixing nip section Y while being heated by the heater lamps 234 and 235 and the induction heating coil unit 241 respectively.

First, the structure and the function of the induction heating coil unit 241 will be explained with reference to FIG. 1. As to the structures and functions of respective members, which constitute the fixing device 23, however, detailed explanations will be given later.

The induction heating coil unit 241 includes an induction heating coil 241*a*, a heat-resistant resin 241*b* and a heat-reflective layer 241*c*, which are formed so as to cover a part of the outer surface section of the pressure roller 232.

In the induction heating coil unit 241, a plurality of cylindrical induction heating coils 241*a* are disposed in an arc. These induction heating coils 241*a* are molded by the heat-resistant resin 241*b*.

The heat-reflective layer 241*c* is formed on the curved surface on the pressure roller side of the induction heating coil unit 241 at position substantially opposing the outer surface section of the pressure roller 232. This heat-reflective layer 241*c* functions to effectively reflect radioactive heat from the pressure roller 232.

Here, the induction heating coil 241*a* made of a single aluminum wire is adopted to improve heat resistance. For the heat-resistant resin 241*b*, epoxy resin, liquid crystal polymer, etc., may be adopted. The heat-resistant layer 241*c* is formed by coating the curved surface on the pressure roller side of the induction heating coil unit 241 (the portion on the pressure roller side of the heat-resistant resin 241*b*) with chromate.

The conduction of current from the excitation circuit 242 to the induction heating coil 241*a* is controlled by the heat control circuit 243.

On the other hand, the pressure roller 232 includes a heat generating layer 232*d* which generates heat by induction heating. For the material of the heat generating layer 232*d*, iron, SUS 430 stainless steel, or other material that can be heated by induction heating may be adopted.

In the foregoing induction coil unit 241 and the pressure roller 232, by supplying high-frequency current from the excitation circuit 232 to the induction heat coil 241*a*, an alternating magnetic field is generated in the heat-generating layer 232*d*. As a result, electromagnetic induction is generated, which, in turn, generates the induction current in the heat generating layer 232*d*, thereby heating (induction heating) the surface of the pressure roller 232 by its module heat.

As described, in the foregoing inducting heating system adopting the induction heating coil unit 241 for the heating means of the pressure roller 232, the heat is generated directly from the heat generating layer 232*d* on the surface of the pressure roller 232. Therefore, the induction heating system offers a significantly higher heat efficiency, and at the same time, offers a wider heating area.

Namely, in the inducting heating system, a large amount of heat can be supplied to the surface of the pressure roller 232, whereby the pressure roller 232 can be heated in a shorter period of time.

Additionally, according to the induction heating system, the induction heating coil unit 241 (external heating means) itself is not heated unlike the case of the external roller heating system, and it is therefore possible to reduce the power consumption loss due to radiation from the external heating means.

The induction heating coil unit 241 is provided so as to cover a part of the outer surface section of the pressure roller 232 and include the heat-reflective layer 241*c* formed on the curved surface on the pressure roller side of the induction heating coil unit 241. This structure therefore offers the effect of suppressing a heat loss due to the radiation from the surface of the pressure roller 232, and the effect of suppressing an energy loss at the induction heating coil 241*a* by preventing an increase in the temperature of the induction heating coil 241*a* and an increase in electric resistance value of the induction heating coil 241*a*, whereby an overall heat efficiency of the fixing device 23 can be improved and a power consumption of the fixing device 23 can be reduced.

As will be described later, the fixing roller 231 is made of an iron series material, or other material to be heated by induction heating, and therefore, a part of the flux leaked from the induction heating coil 241*a* is absorbed by the induction heating coil 241*a*, which can be used to generate heat in the fixing roller 231. Therefore, the magnetic flux generated in the induction heating coil 241*a* can be utilized effectively, which offers the effects of improving the overall heat efficiency of the fixing device 23 and reducing power consumption.

The induction heating coils 241*a* are formed in an arc shape with curvature, which makes the magnetic flux concentrate to the center of the induction coil 241*a*, and increases an amount of eddy current generated. As a result, the surface temperature of the pressure roller 232 can be increased quickly.

Furthermore, since the induction heating coil unit 241 does not contact the pressure roller 232, the problems associated with the external heat roller system such as the external heat roller 131 being stained by toner T, paper powders, etc., or the slipping or noise sound generated at the external heat roller 133, etc., can be eliminated.

The induction heating coil unit 241 of the present embodiment may be arranged as shown in FIG. 2. Namely, the induction heating coils 241*a* are fixed onto the inner surface of the arc shaped coil holder 241*d* made of heat-resistant resin, and a heat-resistant plated part 241*e* is directly formed on the surface of the coil wire member of the induction heating coil 241*a*.

With this structure, the plated surface of the induction heating coil 241*a* directly faces the surface of the pressure roller 232. It is therefore possible to effectively reflect the radiation from the pressure roller 232. Namely, the foregoing structure offers the effect of suppressing a heat loss due to the radiation from the surface of the pressure roller 232, and the effect of suppressing an energy loss at the induction heating coil 241*a* by preventing an increase in the temperature of the induction heating coil 241*a* and an increase in electric resistance value of the induction heating coil 241*a*, whereby an overall heat efficiency of the fixing device 23 can be improved. Incidentally, although for the plated part 241*e*, a hard chromium plate is adopted, the present invention is not intended to be limited to this as long as the plated part 241*e* is plated with a heat-resistant material.

Here, the induction heating coil 241*a* is made of a single aluminum wire (coated with a surface insulating layer, for example, oxidation film) for better heat resistance. Alternatively, the coil 241*a* may be made of a copper wire, a copper-based composite wire, or a litz wire (for example, multistranded enameled wire). Irrespectively of the election of the material for the induction heating coil 241*a*, it is preferable that the total resistance of the induction heating coil 241 be 0.5 Ω or less, preferably 0.1 Ω or less, in order to restrain the Joule loss in the induction heating coil 241.

Here, the length of the induction heating coil unit 241 may be adjusted according to the size of the recording sheet P for fixing thereon the toner T or the passing speed of the recording sheet P at the nipping section Y, etc.

In the present embodiment, the heat-resistant layer 241*c* is formed by coating the curved surface on the pressure roller side in the induction heating coil unit 241 with chromate. However, the heat reflective layer 241*c* of the present embodiment is not limited to this, and may be formed by any heat-resistant material.

Incidentally, the heat-reflective layer 241*c* may be omitted from the structure shown in FIG. 1, and the induction heating coil unit 241 may be constituted by the induction heating coil 241*a* and the heat-resistant resin 241*b*. In the structure shown in FIG. 2, the plated part 241*e* may be omitted from the surface of the coil wire member of the induction heating coil 241*a* from the structure shown in FIG. 2.

Next, the structures and the functions, etc., of respective members which constitute the fixing device 23 will be explained.

The heater lamps 234 and 235 are provided inside the fixing roller 231, and serve as an internal heat supply. Specifically, when fed with electric current by a heat control circuit 243, the heater lamps 234 and 235 emit light at the infrared wavelengths with a predetermined heat distribution. As a result, the entire inner surface of the fixing roller 231 can be heated to substantially uniform temperature. Here, the heater lamps 234 and 235 have a combined power rating of 700 W.

In the present embodiment, halogen heaters are used for the heater lamps 234 and 235. However, the internal heat supply to be provided in the fixing roller 231 is not limited to this and any heating means that permits the entire surface of the fixing roller 231 to be heated uniformly may be adopted. For example, the direct heating method wherein the heat generating layer is formed directly onto the core metal 231*a* of the fixing roller, or the internal heating type inducting heating system wherein the induction heating coil 241*a* is adopted in the fixing roller 231 may be adopted.

The fixing roller 231 is heated to a predetermined temperature (190° C. in this example) by the heater lamps 234 and 235 to heat the recording sheet P having formed thereon an image of unfixed toner passing through the fixing nip section (press contact region) Y of the fixing device.

The fixing roller 231 includes a core metal 231*a* that forms the main body of the heat roller 231, and a releasing layer 231*b*. This releasing layer 231*b* is provided on the outer surface of the core metal 231*a* to prevent the toner T on the recording sheet P from offsetting.

For the core metal 231*b*, for example, iron, stainless steel, aluminum, copper, or an alloy of these metals may be adopted. The core metal 231*b* adopted in the present embodiment is made of iron (STKM) and has a diameter of 40 mm and a thickness of 0.4 mm to reduce thermal capacity.

The releasing layer 231*b* is suitably made of fluororesin, such as PFA (perfluoroalcoxyalkane; a copolymer of tetrafluoroethylene and perfluoroalkylvinylether) or PTFE (polytetrafluoroethylene); a silicone rubber; a fluororubber; or a similar material. Here, the releasing layer 231*b* of the present embodiment is formed by applying and baking a mixture of PFA and PTFE to a thickness of 25 μm.

The pressure roller 232 is pressed to the fixing roller 231 by a spring or other pressure member (not shown) with a force of, for example, 274 N. Then, the fixing nip section Y, about 6 mm wide, is formed between the pressure roller 232 and the fixing roller 231. With this structure, the recording sheet P having formed thereon an image of unfixed toner T is heated at the fixing nip section Y.

As explained earlier, the pressure roller 232 has a quadri-layer structure made up of the core metal 232*a*, the heat-resistant elastic layer 232*b* made of silicone rubber, etc., the heat generating layer 232*d* and a releasing layer 232*c* (outermost layer) which are formed on the outer surface of the metal core 232*a* in this order.

The core metal 232*a* is preferably made of aluminum, stainless steel, steel, etc. In the present embodiment, aluminum is adopted for the material of the metal core 232*a* to prevent the generation of heat by the induction heating, and the diameter of the metal core 232*a* is selected to be 28 mm. On this core metal 232*a*, formed is the heat-resistant elastic layer 232*b* made of foamed silicone rubber with a thickness of 6 mm.

As explained earlier, a heat generating layer 232*d* is a heat generating member for generating heat by induction heating (to be heated by induction heating). To reduce the rising time of the surface temperature, it is preferable that the heat generating layer 232*d* be formed thin in a range of 40 μm to 50 μm. This heat generating layer 232*d* is to be induction heated, and thus for the material of the heat generating layer 232*d*, adopted is iron, SUS 430 stainless material, or other electrically conductive material with magnetization. However, the material of the heat generating layer 232*d* is not limited to the above, silicon steel plate, electromagnetic steel plate, nickel steel, etc., having high specific conductivity may be adopted. In the present embodiment, nickel having a thickness of 40 μm prepared by electroforming may be adopted.

Non-magnetic materials, such as SUS 304 stainless, which shows high resistance may also be used for the heating layer 232*d*, because such materials permit induction heating. Even a non-magnetic base member (for example, ceramics) may be adopted, provided that the layer 232*d* exhibits sufficient conductance and high specific permeability.

It may be arranged so as to adopt a layer made of a plurality of materials for the heat generating layer 232*d* to increase the amount of heat generated.

In order to prevent the toner T micro-offset to the fixing roller 231 from adhering the pressure roller 232, the surface (outer surface) of the heat generating layer 232*d* is coated with the releasing layer 232*c*.

The releasing layer 232*c* may be made of a fluororesin, such as PTFE (polytetrafluoroethylene) and PFA (a copolymer of tetrafluoroethylene and perfluoroalkylvinylether); elastic materials, such as a silicone rubber, fluororubber, and florosilicon rubber; or sublayers each made of one of these materials.

The fixing roller 231 is provided with thermistors 237 and 238 as temperature detection means on its outer surface. These thermistors 237 and 238 are provided for detecting the surface temperatures of the fixing roller 231. Similarly, the pressure roller 232 is provided with a thermistor 239 as temperature detection means on its outer surface for detecting the surface temperatures of the pressure roller 232. Based on the-resulting temperature data as detected by the termistors 237 to 239, the temperature control means (not shown) controls the conduction of current to the heater lamps 234 and 235 and the excitation circuit 236 respectively, so as to maintain the respective surfaces of the pressure roller 131 and the fixing roller 231 and the pressure roller 232 at predetermined temperatures.

Figure 3:
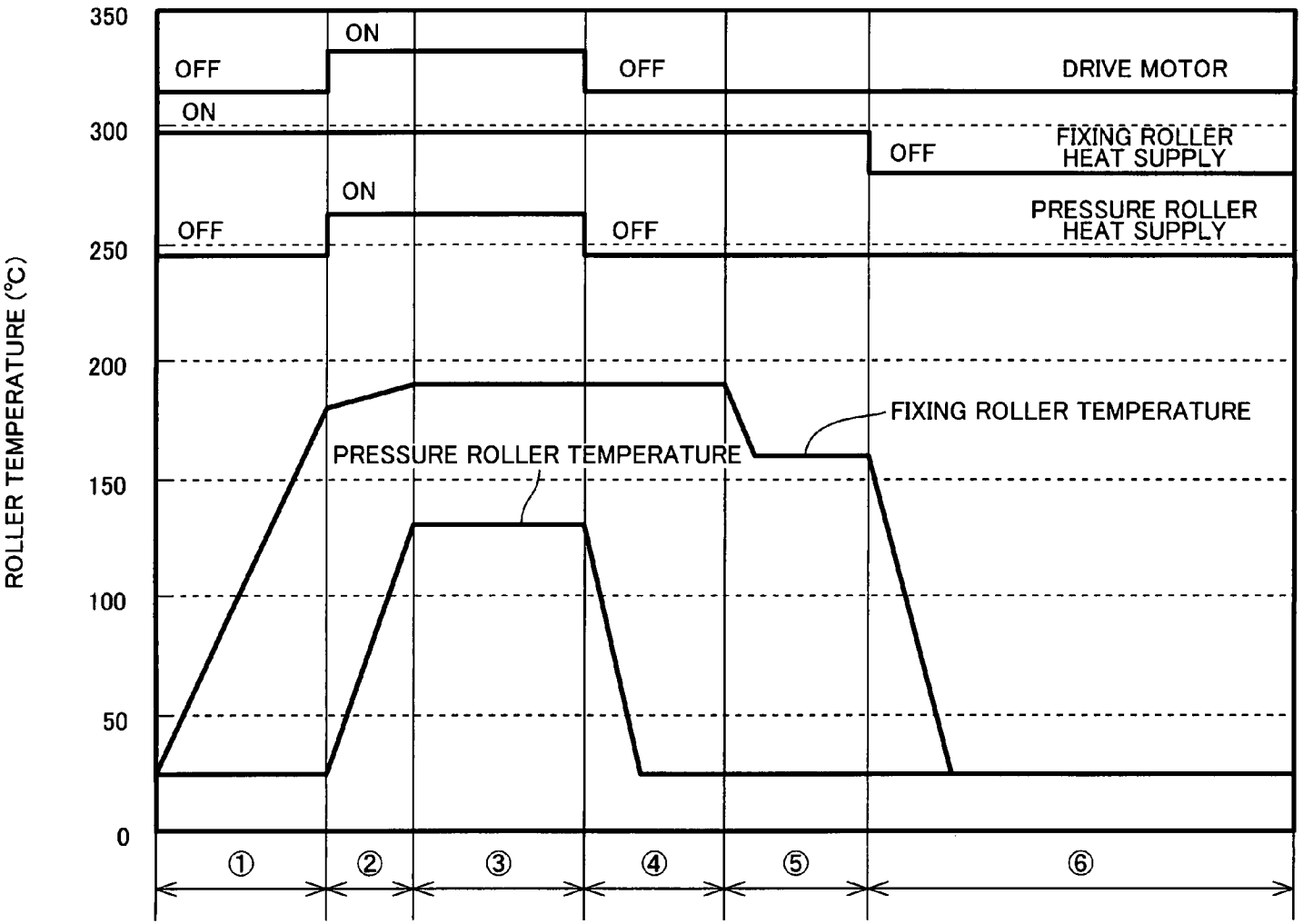
FIG. 3 shows a driving control sequence of the fixing device of the present invention.

Next, the driving control method of the fixing device 23 in accordance with the present embodiment will be explained with reference to FIGS. 1 and 3. FIG. 3 is a graph showing a driving control sequence.

In the present embodiment, the induction heating means is adopted for the heating means of the pressure roller 232, and the heating system for uniformly heating the entire roller in the circumferential direction by the internal heat supply (heater lamps 234 and 345) is adopted for the heating system for the fixing roller 231.

Specifically, in the state where the rollers (the fixing rollers 231 and the pressure roller 232) are not rotating, such as in the wait mode, etc., only the heat supply on the fixing roller 231 side is set ON, and the conduction of supply to the induction heating coil 241*a* on the side of the pressure roller 232 is set OFF. With this structure, since the pressure roller 232 is not rotating, the following problems can be prevented. That is, only the outer surface part covered with the induction heating coil 241*a* is excessively heated (locally heated), which causes non-uniform heating between the part along which the induction heat coil is formed and other part of the outer surface portion of the second heating member, or the damage of the roller at the excessively heated part.

Similarly, when warming up, it is preferable that the conduction of current to the induction heating coil 241 be set OFF until the start of the previous rotation, i.e., in the state where the rollers (the fixing roller 231 and the pressure roller 232) are not rotating, and the conduction of current to the induction heating coil 241*a* be set ON after the rollers start rotating.

Incidentally, the conduction of current from the excitation circuit 242 to the induction heating coil 241 is controlled by the heating control circuit 243.

The warming up rate of the pressure roller 232 by the induction heating coil 241*a* is significantly higher than the warming up rate of the fixing roller 231 by the halogen heaters 234 and 235. Therefore, the foregoing control process will not cause such delay in fast printing time in the standby mode, warming up time in a warm-up mode, etc.

The following will explain the driving control method of the fixing device 23 in accordance with the present embodiment with reference to FIG. 3.

Warm-Up Mode (Corresponding to ① in FIG. 3)

In the warm-up mode, firstly, in the state where the driving motor is set OFF, current is supplied to the heater lamps 234 and 235 to heat the fixing roller 231 to the previous rotation start temperature (180° C. in the present embodiment). After the fixing roller 231 is heated to the previous rotation start temperature (① in FIG. 3), the driving motor is set ON, and the roller is rotation driven at the peripheral velocity of 365 mm/s (fixing rate). In the meantime, the induction heating coil 241 is conducted to heat the fixing roller 231 and the pressure roller 232 to predetermined temperatures (190° C. for the fixing roller and 125° C. for the pressure roller in the present embodiment).

Print Mode (Heating Mode) (Corresponding to ③ in FIG. 3)

In the print mode, the conduction of current to the heater lamps 234 and 235 and the induction heating coil 241*a* is controlled so as to maintain the fixing roller temperature Th1 at 190° C., and the pressure roller temperature TP1 at 125° C. respectively. The recording sheet P having formed thereon an image of unfixed toner T is transported to the fixing nip section Y at a copying speed of 65 sheets per minute (passing time at the fixing nip section Y is 19.2 msec), thereby fixing the image of toner T. Wait Mode The wait mode includes a standby mode (corresponding to ④), an energy saving mode (corresponding to ⑤) and a sleep mode (corresponding to ⑥).

In the standby mode, the driving motor is set OFF, and only the heater lamps 234 and 235 are conducted to maintain the fixing roller 231 at Th1 (190° C.) that is the same temperature as the temperature in the copying mode.

In the energy saving mode, the driving motor is set OFF, and only the heater lamps 234 and 235 are conducted, to control the fixing roller temperature at Th2 (160° C.) that is lower than the temperature in the copying mode.

In the sleep mode, the driving motor is set OFF, and the conduction of current to all the heater lamps 234, 235, and the induction heating coil 241*a*, etc., is set OFF.

Here, the results of comparison in average power consumption when passing the recording sheet (40 sheets are fed successively) between the case where the induction heating system is adopted and the case where the roller heating system is adopted (comparative example) are shown in FIG. 1.

In the case where the induction heating means (induction heating coil unit 241) is provided with the heat reflective function (structures 1 and 2), the power consumption of the external heating means can be reduced by around 24 W, and an overall power consumption of the can be reduced by around 24W. The foregoing effects can be achieved from the structures 1 and 2 for the following reasons. Namely, according to the structures 1 and 2, it is possible to reduce the heat loss due to the radiation from the pressure roller 232, and to suppress an increase in temperature of the induction heating coil 241*a*. As a result, it is possible to reduce the heat loss at the induction heating coil 241*a* with an increase in resistance value.

Next, the image forming apparatus (copying machine) adopting the foregoing fixing device 23 will be explained with reference to FIGS. 5 to 12.

Figure 5:
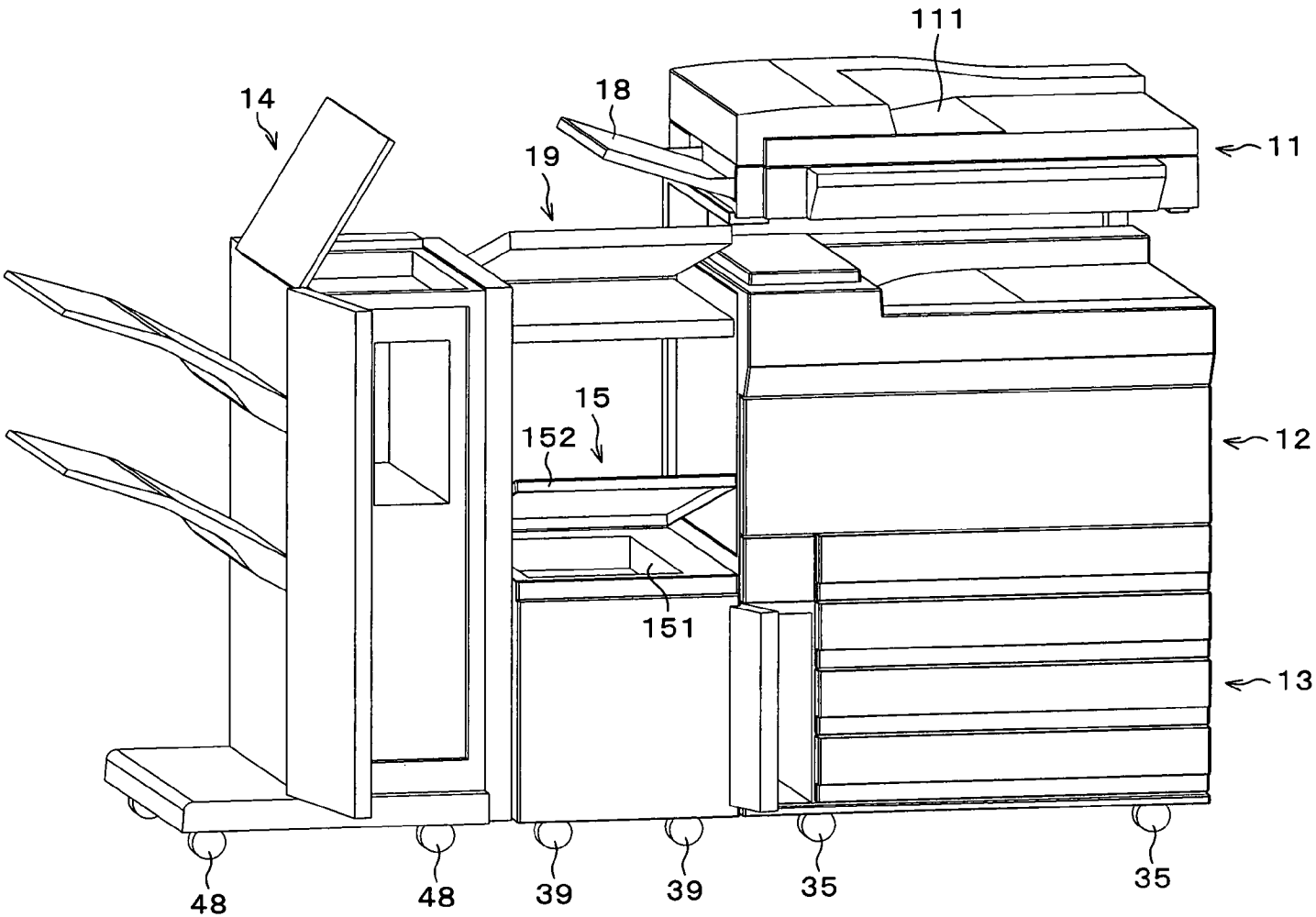
FIG. 5 is a perspective view of the image forming apparatus adopting the heating device of FIG. 1.
Figure 6:
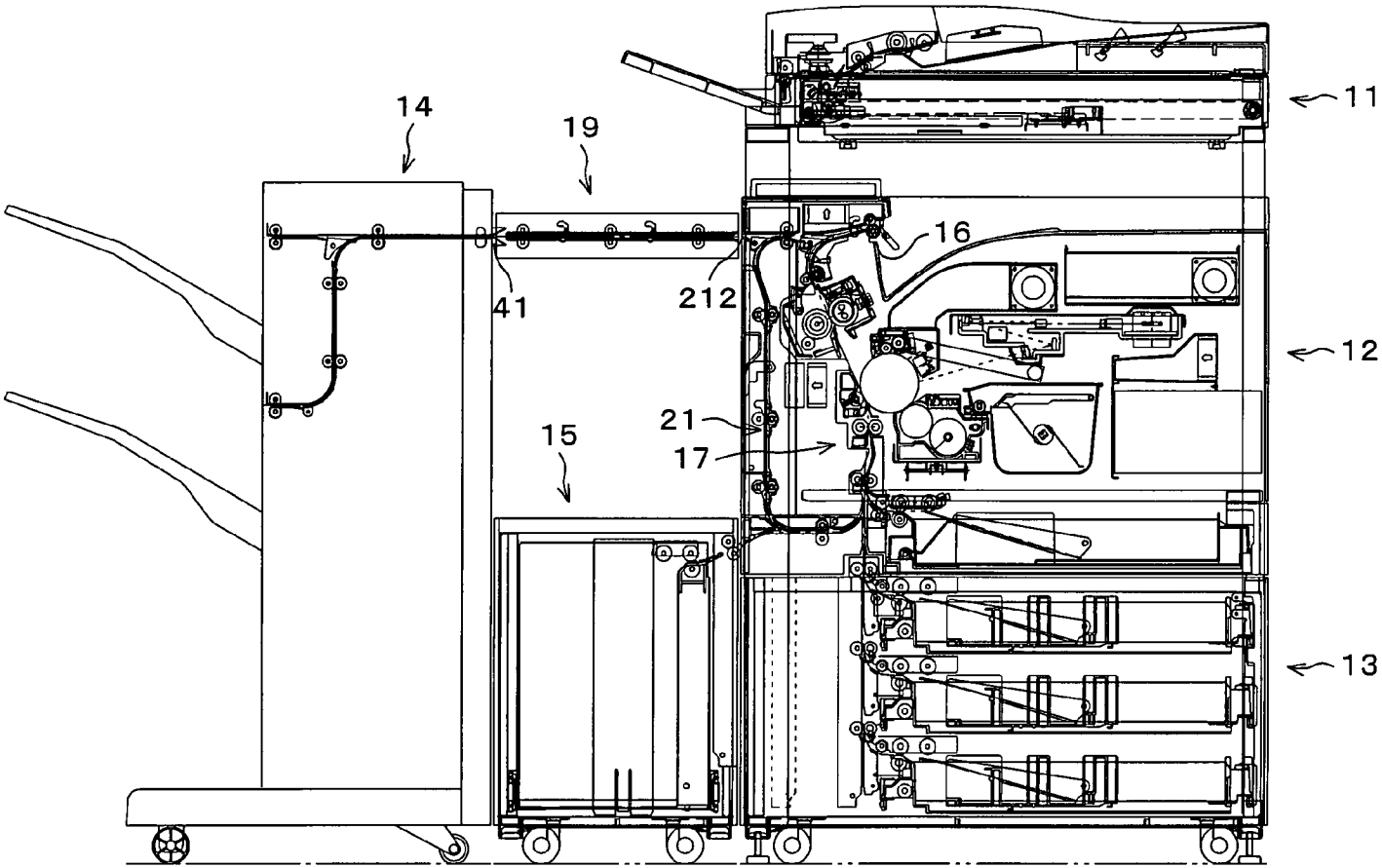
FIG. 6 shows the internal structure of the image forming apparatus.
Figure 8:
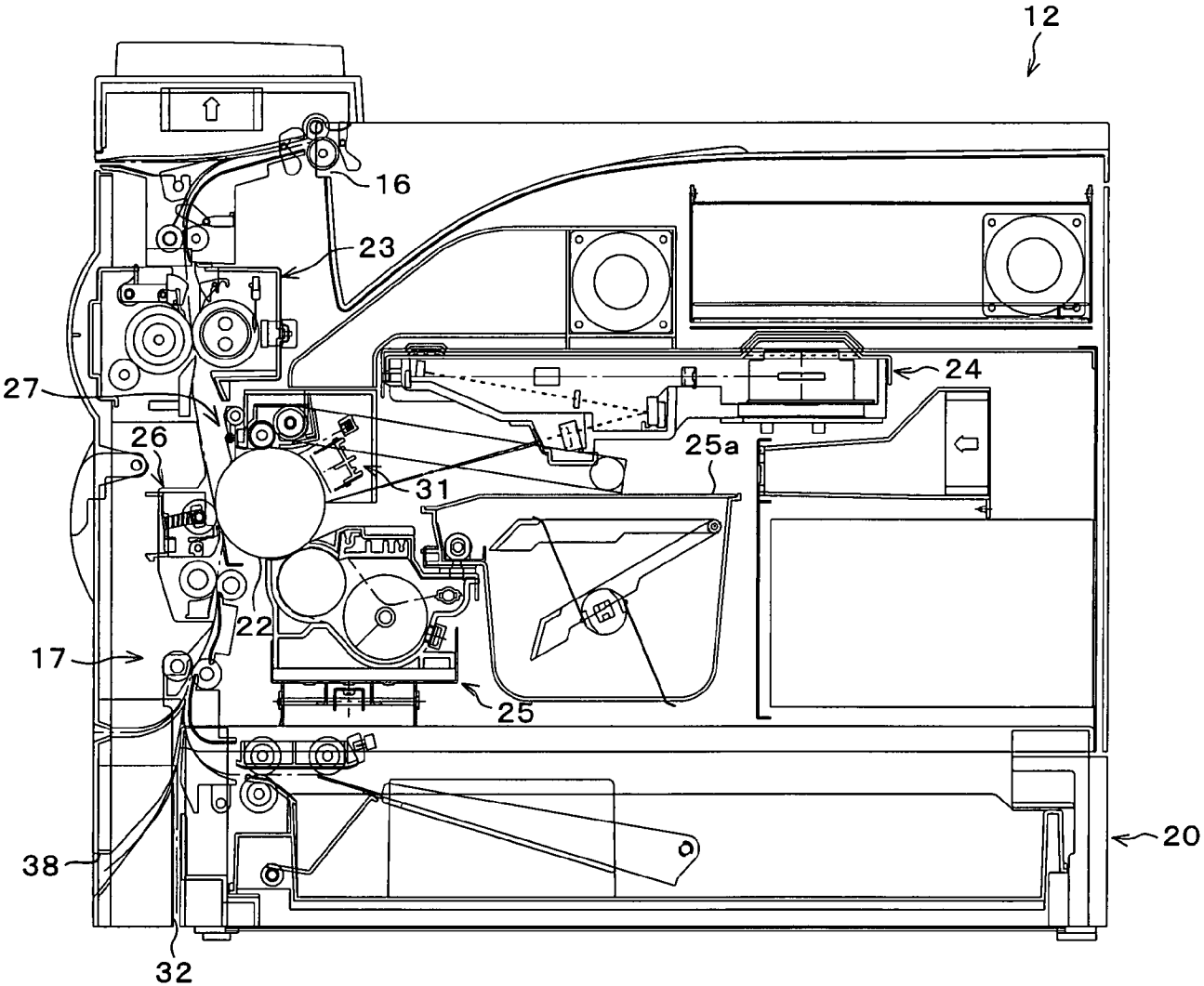
FIG. 8 shows structures of an image recording device of the image forming apparatus.

FIG. 5 is a perspective, external view showing the image forming apparatus. FIG. 6 is a drawing showing the internal structure of the image forming apparatus. FIG. 8 is a perspective, external view showing the image forming apparatus.

TABLE 1

Figure 4:
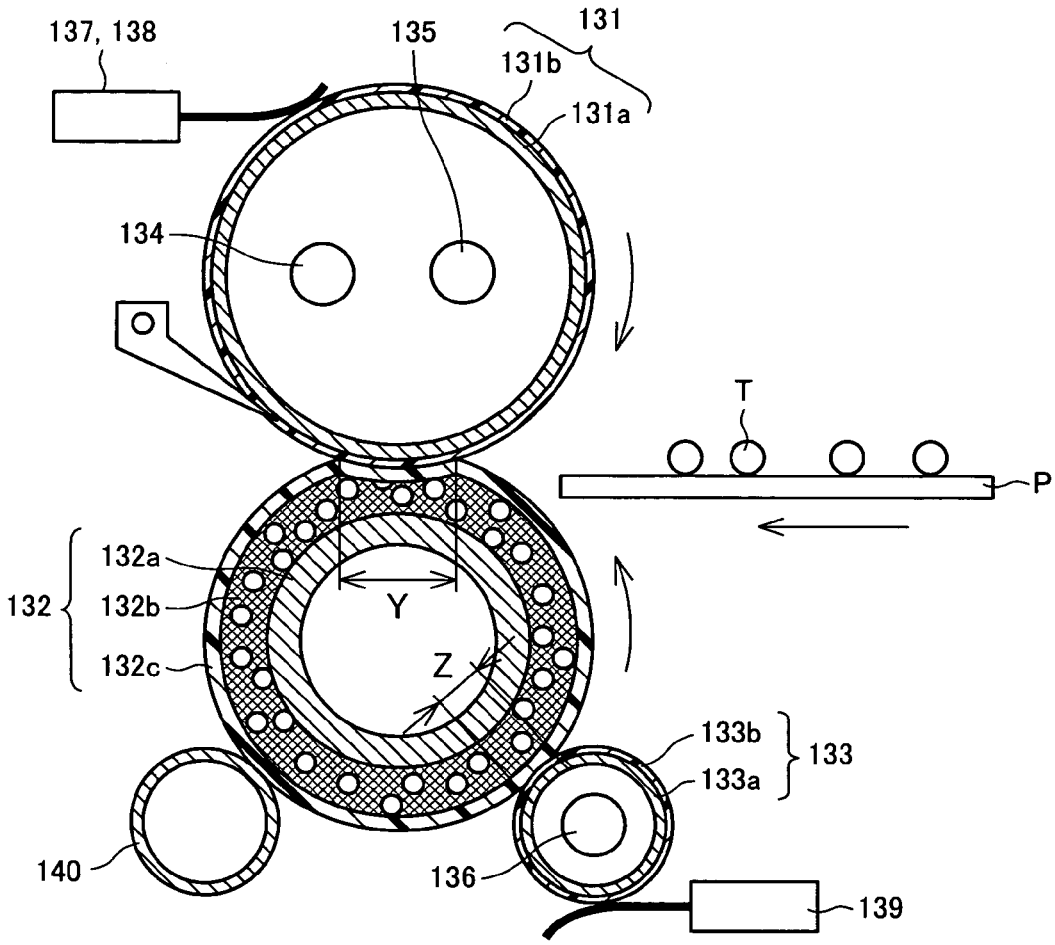
FIG. 4 shows schematic structures of essential parts of a conventional fixing device adopting an external heat roller.

| | STRUCTURE 1 FIG. 1 | STRUCTURE 2 FIG. 2 | STRUCTURE 3 FIG. 1 (WITHOUT HEAT REFLECTIVE LAYER) | COMPARATIVE EXAMPLE FIG. 4 |
|---|---|---|---|---|
| EXTERNAL HEATING SYSTEM | INDUCTION HEATNG SYSTEM | | | |
| HEAT REFLECTIVE LAYER (SURFACE IS PLATED) | PROVIDED | PROVIDED | NOT-PROVIDED | |
| FIXING ROLLER SET TEMPERATURE | 190° C. | 190° C. | 190° C. | 190° C. |
| PRESSURE ROLLER SET TEMPERATURE | 125° C. | 125° C. | 125° C. | (125° C.) |
| EXTERNAL ROLLER SET TEMPERATURE | — | — | — | 200° C. |
| POWER CONSUMPTION WHEN PASSING SHEET | | | | |
| FIXING ROLLER HEAT SUPPLY | 693 W | 693 W | 693 W | 677 W |
| EXTERNAL HEAT SUPPLY | 120 W | 120 W | 144 W | 261 W |
| TOTAL | 813 W | 813 W | 837 W | 938 W |

In the present embodiment, the structure 1 (the structure of FIG. 1), the structure 2 (the structure of FIG. 2) and the structure 3 (the heat reflective layer 241*c* is omitted from the structure of FIG. 1) are considered.

As can be seen from Table 1, in the induction heating system (structure 3) of the present embodiment, as compared to the roller heating system (comparative structure), it is possible to reduce the power consumption at the external heating means by around 117 W, and an overall power consumption can be reduced by around 101 W. The foregoing effect can be achieved by the beneficial features of the induction heating system, i.e., an excellent heat efficiency as compared to the roller heating system, free from the radiation from the external heating means, and strong effect of suppressing radiation from the pressure roller 232 by the external heating means.

As shown in FIGS. 5 and 6, the image forming apparatus includes a document image scanner 11, an image recording device 12, a recording material feeder device 13, a post-processing device 14, and an external recording material feeder device 15. The fixing device 23 (see FIG. 8) is provided in the image recording device 12 (detailed later).

An image forming apparatus main body, such as a digital printer, is composed of the image recording device (image forming section) 12, and the recording material feeder device (recording material feeder section) 13. As illustrated in FIG. 6, this image forming apparatus main body includes a transport section 17 transporting the recording material (recording sheet P) from the recording material feeder device 13 via the image recording device 12 to a recording material eject section 16. The main body, if further including the document image reader (image reading device) 11, forms a digital copying machine or facsimile machine.

Figure 7:
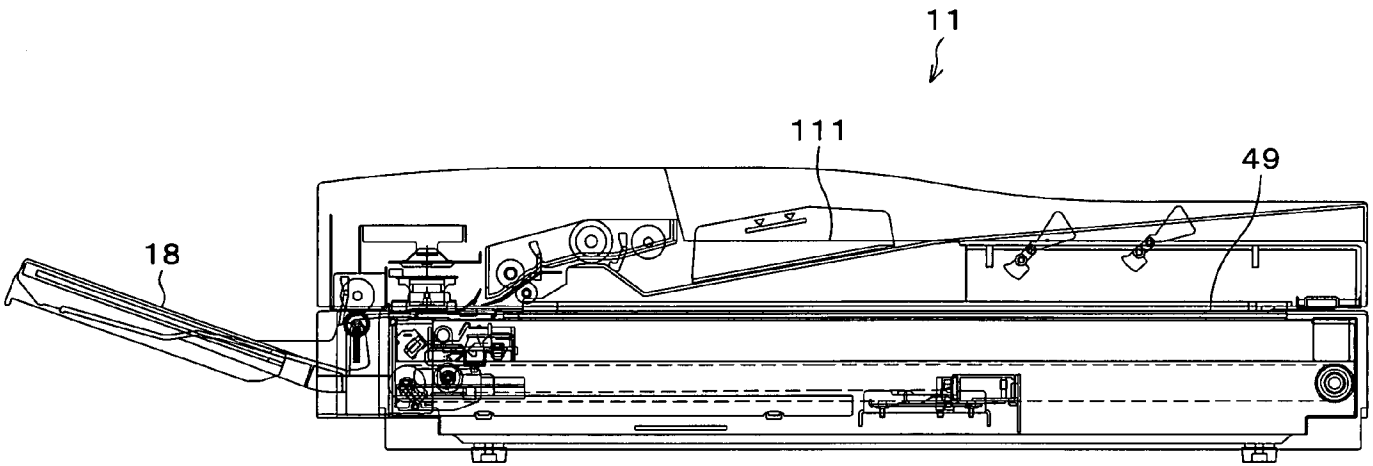
FIG. 7 shows structures of a document image reading device in the image forming apparatus.

The following will describe the operation of the image forming apparatus. Here, FIG. 7 shows the structure of the document image reader 11.

First, the document image reader 11 captures an image data of a document and supplies the image data to the image recording device 12 where the input image data is subjected to a suitable image process.

Meanwhile, the recording material feeder device 13 carries sheet-like recording materials, such as print sheets, OHP (Over Head Projector) sheets, sheet by sheet to the image recording device 12 by the transport section 17.

The image recording device 12 then forms (prints) an image based on the image data on the recording material. The recording material carrying a printed image is transported via a second transport path in the transport section 17 to the recording material eject section 16 where the material is ejected out of the apparatus.

As shown in FIG. 7, the document image reader 11 is provided with a document tray 18 serving as a document feeder section or a document receiving section.

In the case where the document tray 18 serves as the document feeder section, multiple pages of the document placed thereon are fed successively to the image reading section page by page.

On the other hand, in the case where the document tray 18 serves as the document receiving section, the document tray 18 receives and holds the document as read and discharged successively.

Incidentally, in the case of printing plural sets of a sequential document as read, when ejecting a printed recording material to the recording material eject section 16, recording sheets of the same page are successively ejected or otherwise mixed; and the user therefore needs to separate the recording material after printing.

In response, the post-processing device 14 is provided to the image forming apparatus main body to address the problem. The device 14, for example, separates the recording material so that it is ejected to a set of eject trays, preventing multiple pages from being mixed up. The image forming apparatus main body is positioned at a predetermined distance from the post-processing device 14. There is a space formed between the image forming apparatus main body and the post-processing device 14.

The image forming apparatus main body is connected to the post-processing device 14 through an external transport section 19. The recording material having formed thereon a printed image is transported from the transport section 17 via the external transport section 19 to the post-processing device 14.

There is demand for a double-sided print function for savings in energy and cost related to print paper and other recording material. The function is realized by a double-sided printing transport section 21. The section 21 turns over recording material carrying a printed image on one side and transports it again to the image recording device 12.

The recording material carrying a printed image on one side is transported again to the image recording device 12, not to the recording material eject section 16 or the post-processing device 14, after turned over in the double-sided printing transport section 21. The image recording device 12 then prints an image on the blank side, completing double-sided printing.

When recording material of types or quantities exceeding the capacity of the recording material feeder device 13 is to be fed, the external recording material feeder device 15 as a peripheral providing an expanded function is connected to the image forming apparatus main body. Recording material of desired types and quantities can be fed as being put in the external recording material feeder device 15.

Next, the image forming apparatus will be described in more detail, focusing on devices and members constituting it.

FIG. 8 is a drawing showing the structure of the image recording device 12. As shown in the FIG. 8, slightly to the left of the center of the image recording device 12 is there provided an electrophotographic processing section around a photosensitive drum 22.

Around the photosensitive drum 22 are there provided among others: an electrostatic charging unit 31 uniformly charging the surface of the photosensitive drum 22; an optical scan unit 24 scanning the uniformly charged photosensitive drum 22 to write an electrostatic latent image; a developing unit 25 developing the electrostatic latent image written by the optical scan unit 24 with a developing agent; a transfer unit 26 transferring the image developed on the surface of the photosensitive drum 22 to the recording material; and a cleaning unit 27 removing residual developing agent from the surface of the photosensitive drum 22 to allow the formation of a new image on the photosensitive drum 22, the units being disposed in this order.

Above the electrophotographic processing section (image transfer device) is there provided a fixer 23 sequentially receiving the recording material onto which an image has been transferred by the transfer unit 26 and thermally fixing the developing agent (toner) transferred to the recording material.

The recording material carrying a printed image is ejected with the printed side facing downward (facedown) by the recording material eject section 16 in the upper part of the image recording device 12. The residual developing agent removed by the cleaning unit 27 is retrieved and returned to a developing agent supply section 25*a* in the developing unit 25 for reuse.

In the lower part of the image recording device 12, a recording material feeder section 20 is provided containing recording material. The recording material feeder section 20 feeds the recording material sheet by sheet to the electrophotographic processing section.

The transport section 17 is made up of a set of rollers 28 and guides. The recording material is delivered from the recording material feeder section 20 through the first transport path defined primarily by the rollers, the guides, the photosensitive drum 22, and the transfer unit 26. After an image is printed, the recording material is delivered through the second transport path defined primarily by the rollers, the guides, and the fix unit 31 for rejection to the recording material eject section 16.

To refill the recording material feeder section 20 or replace the recording material in the section 20, a recording material containing tray is pulled out perpendicularly to the transport direction for the image recording device 12, that is, toward the front side.

On the bottom of the image recording device 12 is there provided a recording material receiving section 32 receiving the recording material delivered from the recording material feeder device 13 (see FIG. 12) as an expansion unit and sequentially supply the material between the photosensitive drum 22 and the transfer unit 26.

In the empty space around the optical scan unit 24 are there provided among others: a process control unit (PCU) board controlling the electrophotographic processing section; an interface board receiving image data from the outside of the apparatus; an image control unit (ICU) board carrying out predetermined image processes on the image data fed from the interface board and the image data captured by the document image scanner 11 for the optical scan unit to record the image by scanning; and a power supply unit supplying electric power to these various boards and units.

The image recording device 12 alone can be functioned as a printer to be connected to a personal computer or other external device via the interface board and forming an image on recording material according to the image data from the external device.

The foregoing description assumed that there is only one recording material feeder section 20 mounted inside the image recording device 12. This is by no means limiting the invention; two or more recording material feeder sections can be mounted in the device.

Figure 9:
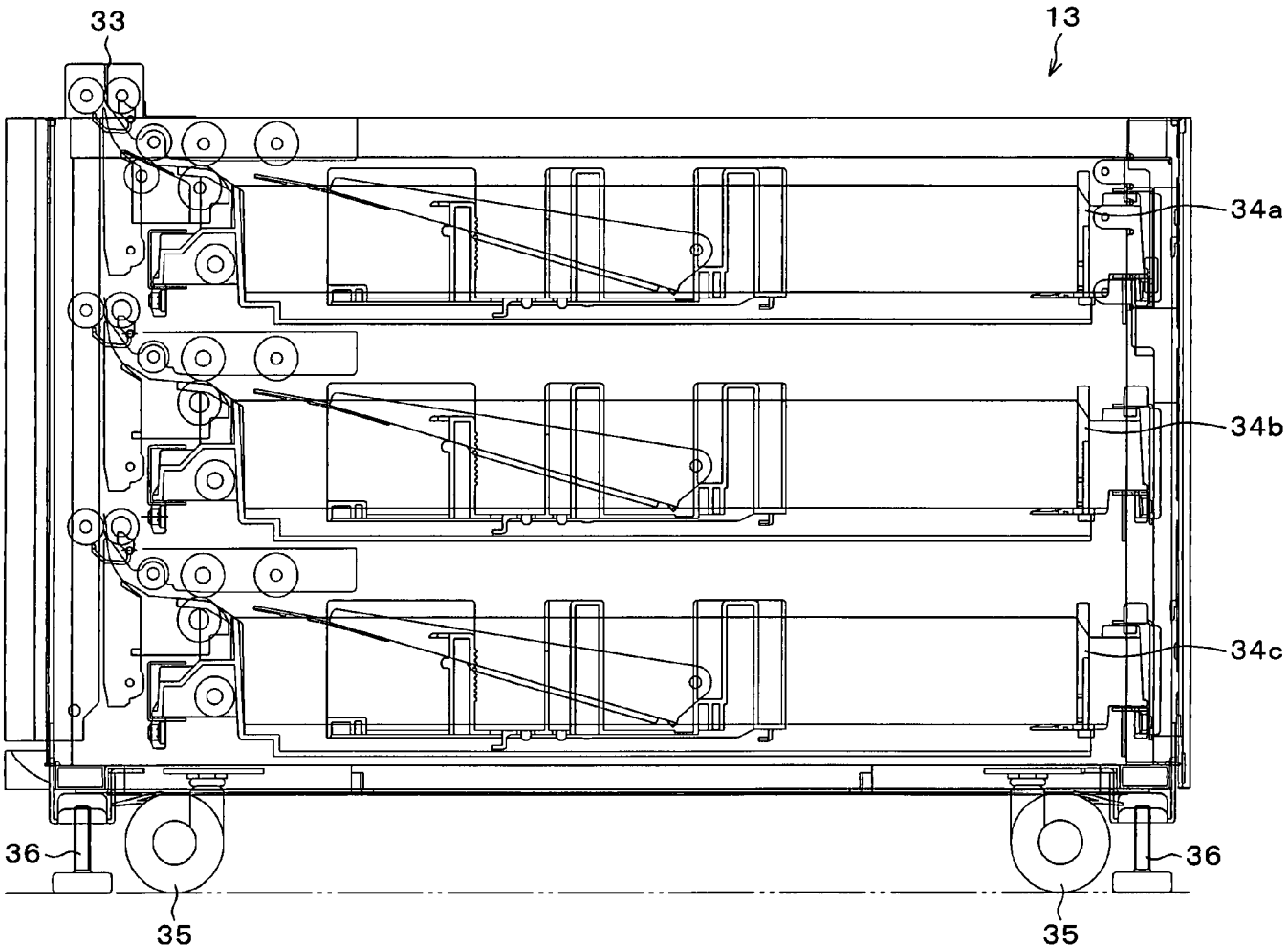
FIG. 9 shows structures of a recording material feeding device of the image forming apparatus.

FIG. 9 is a cross-sectional view showing the structure of the recording material feeder device 13 as an expansion unit. The recording material feeder device 13 can be attached as an expanded part of the image recording device 12 when, for example, the recording material feeder section 20 is incapable of providing the recording material in sufficient quantities.

The recording material feeder device 13 may contain recording material of a larger size than the recording material in the recording material feeder section 20. The device 13 separates the individual sheets of the recording material in it and sends out to the recording material eject section 33 on top of the recording material feeder device 13.

In the recording material feeder device 13, three recording material containing trays 34*a* to 34*c* are provided. One of the stacked recording material containing trays 34*a* to 34*c* containing desired recording material is selectively operated under the control of the PCU for individual delivery of the sheets of the recording material contained.

The recording material sent out from the tray is transported through the recording material eject section 33 and the recording material receiving section 32 in the lower part of the image recording device 12 before reaching the electrophotographic processing section. To refill the recording material feeder device 13 or replace the recording material in the device 13, one of the recording material containing trays 34*a* to 34*c* is pulled out toward the front side of the recording material feeder device 13.

The foregoing description assumed that the three recording material containing trays 34*a* to 34*c* are stacked up; alternatively, the stack may include, for example, at least one tray or three or more trays.

The recording material feeder device 13 has on its bottom a set of wheels 35, rendering movable the whole image forming apparatus main body including the readily recording material feeder device 13 when the device 13 is attached to the main body, for example. Stoppers 36 may be used to render the apparatus and device stationary in place.

Figure 10:
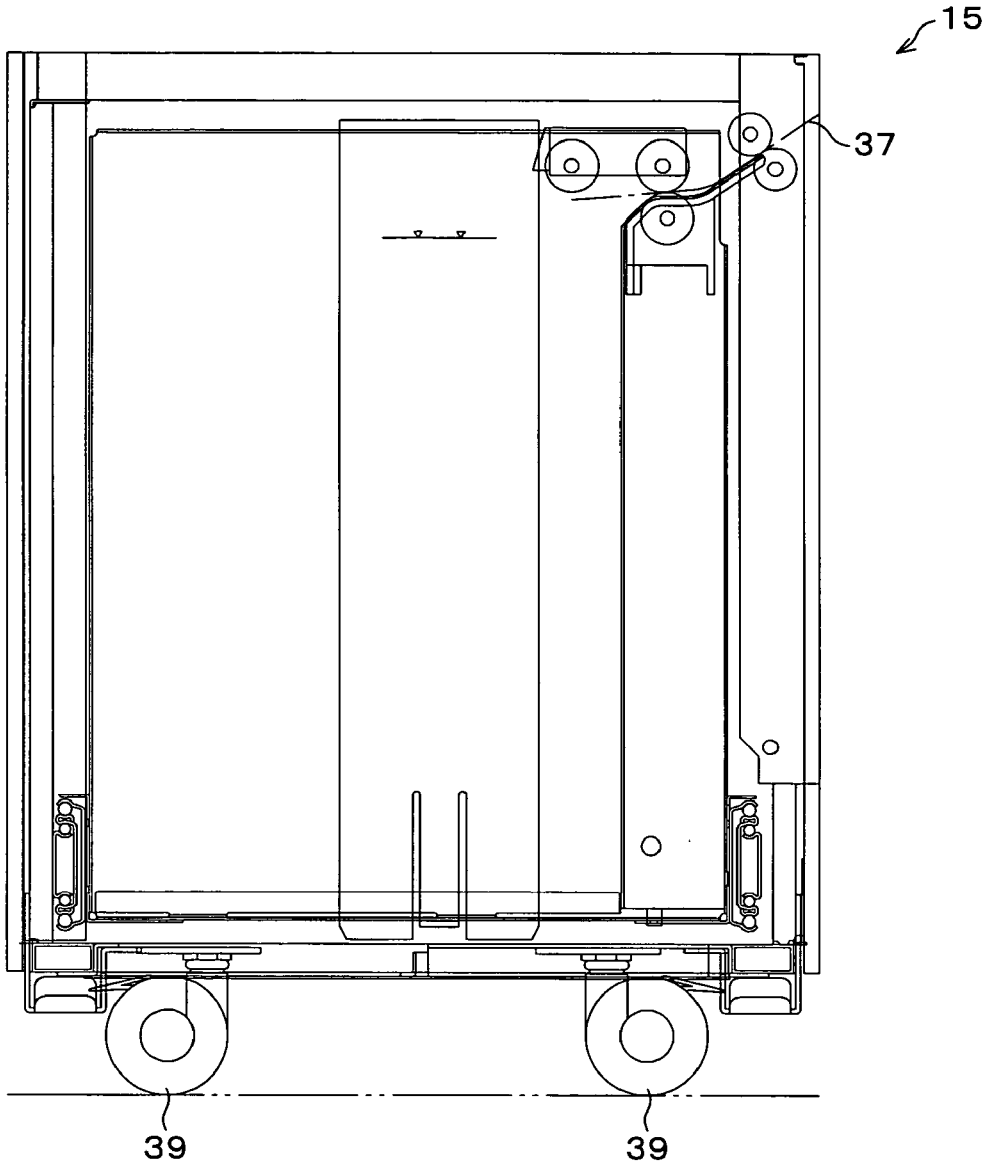
FIG. 10 shows structures of an external recording material feeding device of the image forming apparatus.

FIG. 10 is a drawing showing the structure of the external recording material feeder device 15. The external recording material feeder device 15 is capable of containing recording material of types and quantities exceeding the capacity of the recording material feeder device 13 attached to the image recording device 12, and sends out the contained recording material a sheet at a time to the recording material eject section 37 in the upper part of the device.

The recording material sent out from the recording material eject section 37 is transported to an external recording material receiving section 38 (see FIG. 8) in the lower side part of the image recording device 12.

When the external recording material feeder device 15 is in use, recording material can be additionally put into the external recording material feeder device 15 or substituted for the recording material in the device 15 through a refill opening 151 formed on top of the external recording material feeder device 15 as shown in FIG. 5. The refill opening 151 may have a reclosable lid 152 which is opened for refill or substitution and otherwise kept closed.

Incidentally, a set of wheels 39 are provided on the bottom of the external recording material feeder device 15 so that the device 15 is readily movable when expanded. Stoppers may be used to render the device 15 stationary in place.

Figure 11:
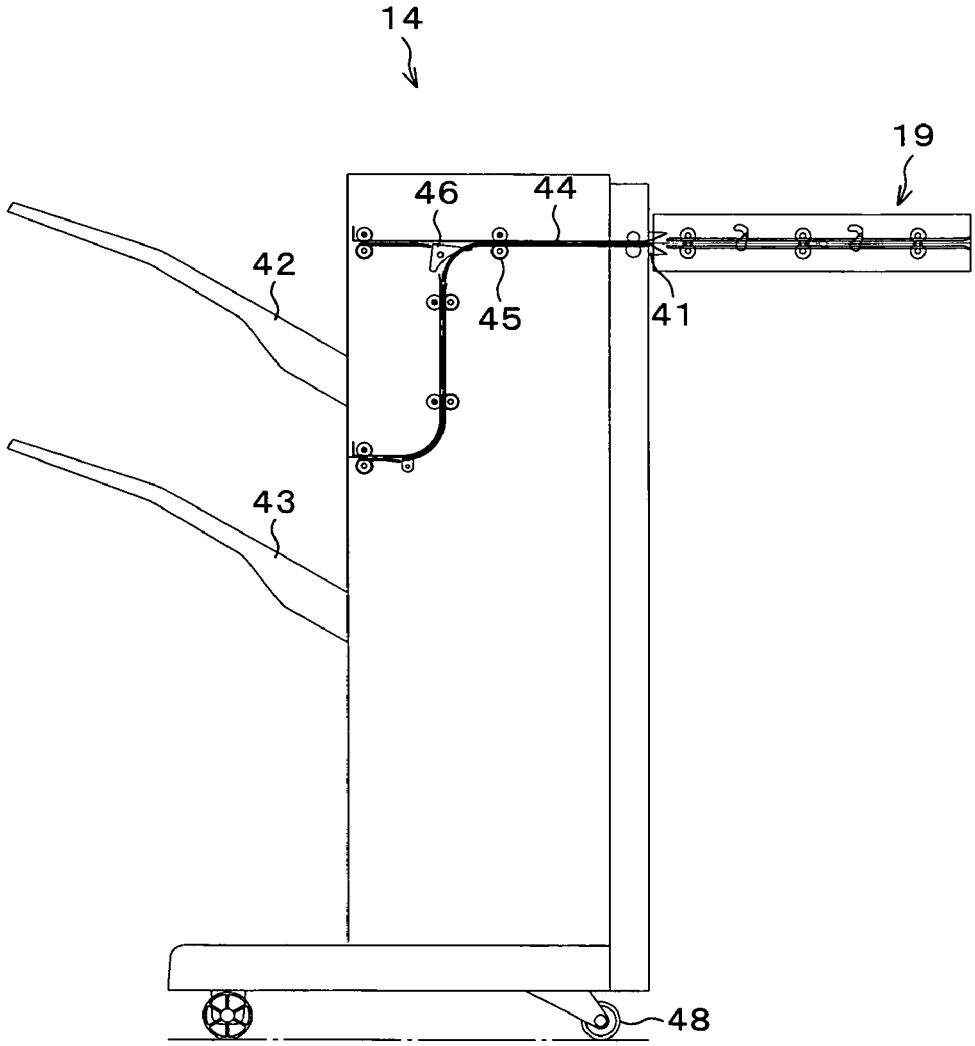
FIG. 11 shows structures of a post-processing after copying device of the image forming apparatus.

FIG. 11 is a drawing showing the structure of the post-processing device 14. As shown in FIG. 9, the post-processing device 14 is placed at a predetermined distance from the image forming apparatus main body. The post-processing device 14 is connected to the image forming apparatus main body by the external transport section 19, so that the external transport section 19 transports the recording material carrying an image printed in the image forming apparatus main body is transported through to the post-processing device 14.

As illustrated in FIG. 6, one end of the external transport section 19 is connected to an external eject section 212 of the image recording device 12, while the other end is connected to a recording material receiving section 41 in the post-processing device 14.

As shown in FIG. 11, the post-processing device 14 has a sorting transport section 44 capable of selectively ejecting the transported recording material to either one of eject trays 42 and 43. The sorting transport section 44 is made up of a set of rollers 45, a guide, and a transport direction switch guide 46. Through the control of the transport direction switch guide 46, the sorting transport section 44 can switch between eject trays. A user can select one of the eject trays 42, 43 to which the recording material will be ejected, to sort out the recording material carrying a printed image upon ejection.

Apart from the aforementioned sort process, post-processing may involve stapling predetermined pages of recording material, folding prints of B4, A3, or another size, opening a hole through the recording material for filing purposes.

Wheels 48 are attached on the bottom of the post-processing device 14 to provide mobility.

The structure of the external transport section 19 is not particularly limited. The external transport section 19 may be mounted to the post-processing device 14 so that the external transport section 19 can detachably connect to the image recording device 12. Alternatively, the external transport section 19 may be detachably mounted to the post-processing device 14 and the image forming apparatus main body 20.

FIG. 7 is a drawing showing the structure of the document image scanner 11. The document image scanner 11 operates in automatic image capture mode whereby an automatic document feeder device (so-called ADF) automatically feeds document sheets for image capturing through optical scanning a sheet at a time and also in manual image capture mode whereby the user manually places document sheets bounded or otherwise rendered impossible for the ADF to handle for image capturing.

The document placed on a transparent document platen 49 which is an image capture section is optically scanned to form an image on photoelectric conversion elements for conversion to electrical signals to obtain image data. The obtained image data is output through a connection to the image recording device 12.

To capture an image of both sides of the document, both sides of the document can be simultaneously scanned somewhere down the document transport path.

To capture an image of the bottom side of the document, a movable optical scan system scanning the bottom of the document platen, stationary at a predetermined position along the document transport path, forms an optical image on CCDs. To capture the top side of the document, there are provided among others: a light source above the document transport path which shines light to the document; optical lenses directing an optical image to the photoelectric conversion elements; a contact image sensor (CIS) built integrally from photoelectric conversion elements converting an optical image into image data.

On the selection of image capturing of both sides of the document, the document placed on the document feeder section 111 is transported sheet by sheet for simultaneous image capturing of both sides of the sheet during the course of the transport.

The document image scanner 11 includes the document tray 18 attached to it. The document tray 18 is used to supply a document before image capturing or receive the document as read. In the former case, as an document before image capturing is placed on the document tray 18, the document is loaded by a loader section of the ADF for transport to the image capture platen 49. After the image capturing, the document is ejected from the device by a document eject section. In the latter, as a document is placed on the document feeder section 111, the document is loaded by the loader section of the ADF for transport to the image capture platen 49. After the image capturing, the document is ejected to the document tray 18 by the document eject section.

Figure 12:
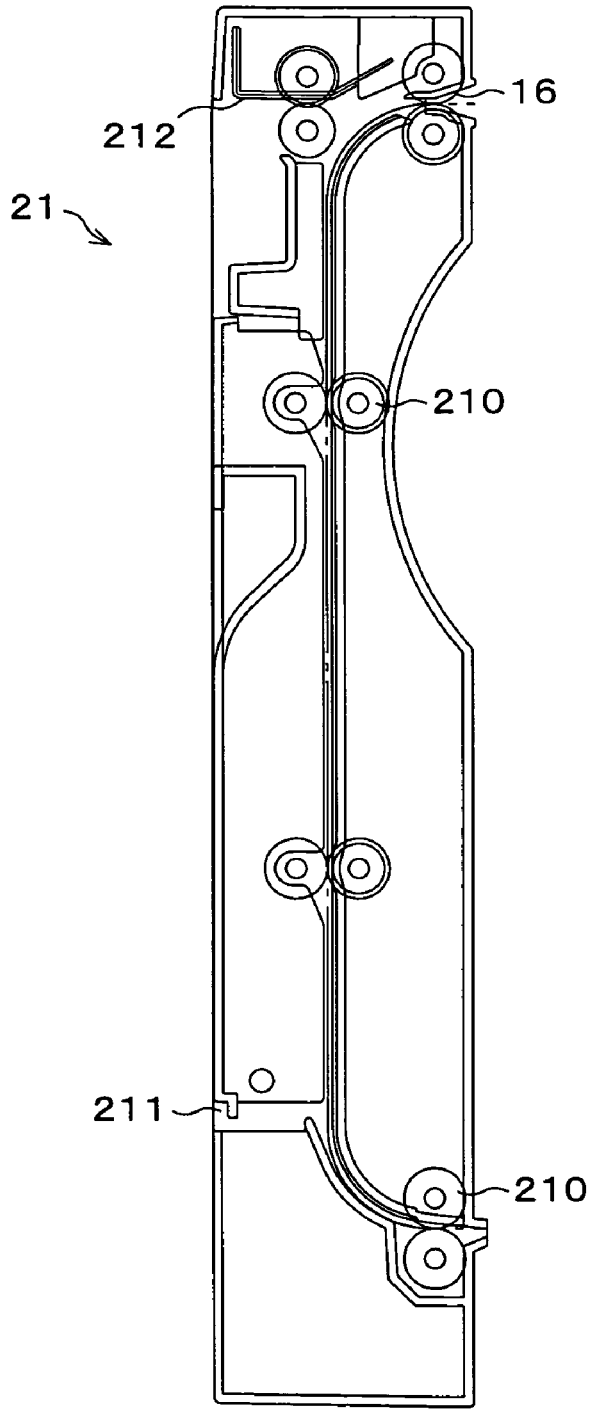
FIG. 12 shows structures of a both-sided printing transport section of the image forming apparatus.

FIG. 12 is a drawing the structure of the double-sided printing transport device 21. The double-sided printing transport device 21 includes a double-sided printing transport section and attached to a side of the image recording device 12 shown in FIG. 11.

The double-sided printing transport section includes a set of rollers 210 transports the recording material ejected from the fixer 23 through a switchback, using the recording material eject section 16 in the upper part of the image recording device. That is, the recording material is turned over, and supplied again between the photosensitive drum 22 and the transfer device 26 in the electrophotographic processing section of the image recording device 12.

In the image forming apparatus 12, the recording material can be guided to the post-processing device 14 in FIG. 11 and the double-sided printing transport device 21 shown in FIG. 12, by transporting the recording material carrying a printed image in a switchback in the transport path ejecting the recording material to the recording material eject section 16 in the upper part of the device.

A heating device which includes a first heating member and a second heating member placed in press contact with each other in a press contact region, wherein a member to be heated is heated by passing through the press contact region, wherein:

at least either one of the first heating member and the second heating member includes a heat generating member to be induction heated and induction heating means for induction heating the heat generating member; and the induction heating means includes a heat reflective function for reflecting heat radiated from the heating member to the heat generating member.

The heating device is arranged so as to apply heat and pressure to the recording material by making the recording material (a recording sheet having formed thereon an unfixed toner image, for example) pass through the press contact region at which the first heating member and the second heating member are placed in press contact with each other.

The induction heating indicates to heat the object to be heated by joule heat of an induction current generated by applying the induction current to the object to be heated by electromagnetic induction.

According to the foregoing structure, the induction heating means is adopted for the heating means of the first heating member and/or second heating member, and it is therefore possible to generate heat from the object to be heated (first heating member and/or second heating member) directly.

The foregoing structure wherein heat is generated directly from the second heating member by the induction heating section offers a higher heat efficiency (heat supplying efficiency) and a wider heating area as compared to the heating system in which heat is applied by making the second heating member in contact with an external high temperature member (external heat roller, for example).

Namely, the foregoing structure of the present invention permits the second heating member to be heated in a shorter period of time, and offers the effect of reducing electric power consumption (saving of energy) when heating.

Furthermore, according to the induction heating system, the induction heating section itself hardly generates heat unlike the case of adopting the external roller heating system, and a waste power consumption with the radiation from the external heating section can be suppressed, thereby reducing an overall power consumption (saving of energy).

The foregoing structure of the present invention wherein the object to be heated (second heating member) is heated directly by the induction heating section provided outside the second heating member offers an excellent noise sound suppression without generating contact sound between the second heating member and the external heat roller.

Furthermore, according to the foregoing structure, the heat radiated from the heating member is reflected towards the heating member by the heat reflecting function of the induction heating means, and it is therefore possible to suppress the heat loss due to the heat radiated from the heating generating member.

With the foregoing structure of the present invention, it is possible to heat the member to be heated in a shorter period of time, and to realize the effect of reducing electric power consumption (saving of energy) when heating.

Incidentally, with the foregoing structure wherein the internal heat supply is provided in the first heating member, it is preferable that the induction heating means for induction heating the second heating member be provided with the heat reflecting function.

For the heating device of the present invention having the foregoing structure wherein the internal heat supply is provided in the first heating member, it is desirable that the heating generating member to be induction heated be provided not only in the second heating member but also in the first heating member.

With the foregoing structure, a part of a magnetic flux as leaked from the induction heating means for heating the second heating member is absorbed also in the first heating member, which makes for the heat generation of the first heating member.

According to the foregoing structure, a part of the magnetic flux as leaked from the induction heating means for heating the second heating member is absorbed by the first heating member, and can be used for generating heat from the first heating member. As a result, the magnetic flux as generated by the induction heating means can be utilized effectively, and an overall heat supplying efficiency of the heating device can be improved, thereby realizing a It is preferable that the heating device of the present invention be further arranged such that:

the second heating member is a cylindrical rotating member; and the induction heating means includes an induction heating coil provided in a vicinity of an outer surface section of said second heating member.

According to the foregoing structure, the heat generating member of the second heating member is heated by the induction heating coil provided in a vicinity of the outer surface (side face) section of the second heating member, and it is therefore possible to uniformly heat the outer surface section (side face) of the second heating member.

With the structure wherein the induction heating coil is formed in a vicinity of the outer surface section of the rotating member (with a curvature), the magnetic flux is concentrated to the center of the induction coil, which increases an amount of eddy current generated. As a result, the surface temperature of the pressure roller can be raised in a short period of time.

It is also preferable that the heating device of the present invention be arranged so as to include a heat reflective layer formed between the induction heating coil and the second heating member, and the heat reflective layer be prepared by plating a surface of a resin layer which supports the induction heating coil.

Incidentally, it may be arranged such that the surface of the induction heating coil is plated for reflecting heat.

According to the foregoing structure, the heat irradiated from the surface of the second heating member is reflected from the plated surface of the induction heating coil or the heat reflective layer towards the second heating member.

It is therefore possible to suppress the heat loss due to the heat radiated from the heating generating member. With the foregoing structure of the present invention, it is possible to heat the member to be heated in a shorter period of time, and to realize the effect of reducing electric power consumption (saving of energy) when heating.

The heat radiated from the second heating member is reflected by the heat reflective layer or the plated surface of the induction heat coil to the second heating member, the heat as radiated is not used to heat the induction heat coil. Namely, with an increase in temperature of the induction heat coil, an electric resistance value increases, and the induction heating coil itself can be prevented from being excessively heated by joule heat.

As a result, heat loss due to the radiation from the surface of the second heating member and the heat (energy) loss at the induction heating coil can be suppressed, thereby realizing saving of energy (reduction in electric power consumption) of the heating device.

It is preferable that heat control means operate the induction heating means only in a state where the second heating member is rotating.

Specifically, it may be arranged such that the first heating member includes an internal heat supply, and the first heating member includes an internal heat supply; and the heating device is provided with (a) a first warm-up mode in which the first heating member and the second heating member are heated in a state where these members are not rotating, (b) a second warm-up mode in which the first heating member and the second heating member are heated in a state where these members are rotating after the first warm-up mode, (c) a heating mode in which a member to be heated is made pass through the heating means, and a wait mode (d) in which the first heating member and the second heating member are preheated in state where these members are not rotating; and the heat control means controls so as to operate only the internal heat supply in the first warm-up mode and the wait mode, and to operate the induction heating means only in the second warm-up mode and the heating mode.

According to the foregoing structure wherein in the state where the second heating member is not rotating, the induction heating means is not operated, the second heating member can be prevented from being excessively heated only at the part of outer surface section covered with the induction heat coil, thereby preventing non-uniform heating between the part along which the induction heat coil is formed and other part of the outer surface section of the second heating member, or the damage of the roller at the excessively heated part.

It is preferable that the foregoing heating device of the present invention be arranged such that the passing time of the member to be heated in the press contact region is not more than 23 msec.

In the high speed apparatus in which the passing time of the member to be heated at a press contact region is not more than 23 msec, it is required to heat the second heating member to high temperature, and the pressure at the press contact region is also high, the second heating member is formed thick and the thermal capacity becomes large by necessity.

Therefore, when the present invention is applied to the foregoing high speed apparatus, the effects as achieved from the heating device of the present invention, i.e., high heat efficiency and low power consumption can be particularly appreciated.

The fixing device of the present invention is provided with the heating device for fixing an unfixed toner.

The heating device arranged such that heat is generated directly from the second heating member, and therefore, in addition to the foregoing functions and effects, it is possible to prevent one of the problems associated with the external heating system, i.e., for example, the recording material is contaminated by the contamination of the recording material due to toner, iron powders, etc.

A heating method of heating a recording material by making the recording material having formed thereon an unfixed toner image pass through a press contact region in which the fixing roller and the pressure roller are in press contact with one another, including the steps of:

heating the first heating member by an internal heat supply provided in the first heating member; and induction heating a portion around a surface of the first heating member in contact with a surface of the recording material on an opposite side of the surface having formed thereon a toner image.

With the foregoing structure, a significantly higher heat efficiency (heat supplying efficiency) and a wider heating area can be realized as compared to the case of adopting the method of heating the second heating member by making the second heating member in contact with the external high temperature member (external roller heating system, for example).

Namely, the foregoing method of the present invention permits the second heating member to be heated in a shorter period of time, and offers the effect of reducing power consumption (saving of energy) when heating.

Furthermore, according to the induction heating system, the induction heating means itself hardly generates heat unlike the case of adopting the external roller heating system, thereby reducing an overall power consumption (saving of energy).

The foregoing method of making the member to be heated (second heating member) directly generate heat offers an excellent noise sound suppression without generating contact sound between the second heating member and the external heat roller unlike the case of adopting the external roller heating system.

The embodiments and examples described in DESCRIPTION OF THE EMBODIMENTS are for illustrative purposes only and by no means limit the scope of the present invention. Variations are not to be regarded as a departure from the spirit and scope of the invention, and all such modifications as would be obvious to one skilled in the art are intended to be included within the scope of the claims below.

What is claimed is:

1. A heating device which includes a first heating member and a second heating member placed in press contact with each other in a press contact region, wherein a recording material having formed thereon an unfixed toner image is heated by passing through the press contact region, said heating device comprising:

an internal heat supply for heating said first heating member; and induction heating means comprising an induction heating coil disposed in an arcuate shape in a vicinity of a surface of said second heating member for heating a portion around the surface of said second heating member in contact with a surface of the recording material on an opposite side of the surface having formed thereon a toner image, said induction heating means being provided outside said second heating member.

2. The heating device as set forth in claim 1, wherein:

said induction heating means is provided with (a) a function for induction heating a heat generating member to be induction heated, said heat generating member being provided in said second heating member, and (b) a heat reflective function for reflecting heat radiated from said heat generating member to said heat generating member.

3. The heating device as set forth in claim 1, wherein:

said first heating member includes a heat generating member to be induction heated.

4. The heating device as set forth in claim 1, wherein:

said second heating member is a cylindrical rotating member; and said induction heating means includes an induction heating coil provided in a vicinity of an outer surface section of said second heating member.

5. A heating device which includes a first heating member and a second heating member placed in press contact with each other in a press contact region, wherein a recording material having formed thereon an unfixed toner image is heated by passing through the press contact region, said heating device comprising:

an internal heat supply for heating said first heating member;

induction heating means for heating a portion around a surface of said second heating member in contact with a surface of the recording material on an opposite side of the surface having formed thereon a toner image, said induction heating means being provided outside said second heating member; and a heat reflective layer formed between said induction heating coil and said second heating member, wherein:

said second heating member is a cylindrical rotating member; and said induction heating means includes an induction heating coil provided in a vicinity of an outer surface section of said second heating member.

6. The heating device as set forth in claim 5, wherein:

said heat reflective layer is prepared by plating a surface of a resin layer which supports said induction heating coil.

7. The heating device as set forth in claim 4, wherein:

a surface of said induction heating coil is plated for reflecting heat.

8. The heating device as set forth in claim 4, further comprising:

heat control means for operating said induction heating means only in a state where said second heating member is rotating.

9. A heating device which includes a first heating member and a second heating member placed in press contact with each other in a press contact region, wherein a recording material having formed thereon an unfixed toner image is heated by passing through the press contact region, said heating device comprising:

an internal heat supply for heating said first heating member;

induction heating means for heating a portion around a surface of said second heating member in contact with a surface of the recording material on an opposite side of the surface having formed thereon a toner image, said induction heating means being provided outside said second heating member; and heat control means for operating said induction heating means only in a state where said second heating member is rotating, wherein:

said second heating member is a cylindrical rotating member;

said induction heating means includes an induction heating coil provided in a vicinity of an outer surface section of said second heating member;

said first heating member includes an internal heat supply; and said heating device is provided with (a) a first warm-up mode in which said first heating member and said second heating member are heated in a state where these members are not rotating, (b) a second warm-up mode in which said first heating member and said second heating member are heated in a state where these members are rotating after said first warm-up mode, (c) a heating mode in which a member to be heated is made pass through said heating means, and a wait mode (d) in which said first heating member and said second heating member are preheated in state where these members are not rotating; and said heat control means controls so as to operate only said internal heat supply in said first warm-up mode and said wait mode, and to operate said induction heating means only in said second warm-up mode and said heating mode.

10. The heating device as set forth in claim 1, wherein:

a passing time of the member to be heated in the press contact region is not more than 23 msec.

11. A heating device which includes a first heating member and a second heating member placed in press contact with one another in a press contact region, wherein a member to be heated is heated by passing through said press contact region, wherein:

at least either one of said first heating member and said second heating member includes a heat generating member to be induction heated and induction heating means comprising an induction heating coil disposed in an arcuate shape in a vicinity of a surface of said heating member for induction heating said heat generating member; and said induction heating means is provided with a heat reflective function for reflecting heat radiated from said heating member to said heat generating member.

12. A heating device which includes a first heating member and a second heating member placed in press contact with one another in a press contact region, comprising:

an internal heat supply provided in said first heating member;

a heat generating member to be induction heated, said heat generating member being provided in a vicinity of an outer surface of said second heating member; and an induction heating section comprising an induction heating coil provided arcuately outside said second heating member.

13. The heating device as set forth in claim 12, wherein:

said first heating member is a fixing roller, and said second heating member is a pressure roller respectively, and said fixing roller and said pressure roller are press contact with one another at their respective side faces; and said induction heating section is an induction heating coil provided in a vicinity of said pressure roller along its side face.

14. A heating device which includes a first heating member and a second heating member placed in press contact with one another in a press contact region, comprising:

an internal heat supply provided in said first heating member;

a heat generating member to be induction heated, said heating member being provided in a vicinity of an outer surface of said second heating member;

an induction heating section provided outside said second heating member; and a metal plated layer formed between said pressure roller and said induction heating coil, wherein:

said first heating member is a fixing roller, and said second heating member is a pressure roller respectively, and said fixing roller and said pressure roller are press contact with one another at their respective side faces; and said induction heating section is an induction heating coil provided in a vicinity of said pressure roller along its side face.

15. The heating device as set forth in claim 13, further comprising:

a heat control circuit which conducts said induction heating coil only in a state where said pressure roller is rotating.

16. The heating device as set forth in claim 15, wherein:

said heat control circuit controls such that in a first warm-up mode in which said pressure roller is not rotating, said induction heating coil is not conducted; in a second warm-up mode in which said second pressure roller is rotating and a heating mode in which said member to be heated passes through said press contact region between said fixing roller and said pressure roller, said induction heating coil is conducted; and in a wait mode in which said pressure roller is not rotating, said induction heating coil is not conducted.

17. A heating device which includes a first heating member and a second heating member placed in press contact with one another in a press contact region, comprising:

an internal heat supply provided in said first heating member;

a heat generating member to be induction heated, said heating member being provided in a vicinity of an outer surface of said second heating member;

an induction heating section provided outside said second heating member; and a heat control circuit which conducts said induction heating coil only in a state where said pressure roller is rotating, wherein:

said first heating member is a fixing roller, and said second heating member is a pressure roller respectively, and said fixing roller and said pressure roller are press contact with one another at their respective side faces; and said induction heating section is an induction heating coil provided in a vicinity of said pressure roller along its side face;

said heat control circuit controls such that in a first warm-up mode in which said pressure roller is not rotating, said induction heating coil is not conducted; in a second warm-up mode in which said second pressure roller is rotating and a heating mode in which said member to be heated passes through said press contact region between said fixing roller and said pressure roller, said induction heating coil is conducted; and in a wait mode in which said pressure roller is not rotating, said induction heating coil is not conducted; and said heat control circuit controls such that said internal heat supply of said fixing roller is conducted in said first warm-up mode and said wait mode.

18. A fixing device comprising:

heating device which includes a first heating member and a second heating member placed in press contact with one another in a press contact region, wherein a recording material having formed thereon an unfixed toner image is heated by passing through said press contact region between said first heating member and said second heating member, said heating device comprising:

an internal heat supply for heating said first heating member; and induction heating means comprising an induction heating coil disposed in an arcuate shape in a vicinity of a surface of said second heating member for heating a portion around the surface of said second heating member in contact with a surface of the recording material on an opposite side of the surface having formed thereon a toner image, said induction heating means being provided outside said second heating member.

19. A fixing device comprising a heating device which includes a first heating member and a second heating mem ber placed in press contact with one another in a press contact region, wherein said heating device comprises:

an internal heat supply provided in said first heating member;

a heating member to be induction heated, said heating member being provided on an outer surface of said second heating member; and an induction heating section comprising an induction heating coil provided arcuately in a vicinity of said heat generating member outside said second heating member.

20. An image forming device comprising:

heating device which includes a first heating member and a second heating member placed in press contact with one another in a press contact region, wherein a recording material having formed thereon an unfixed toner image is heated by passing through said press contact region between said first heating member and said second heating member, said heating device comprising:

an internal heat supply for heating said first heating member; and induction heating means comprising an induction heating coil disposed in an arcuate shape in a vicinity of a surface of said second heating member for heating a portion around the surface of said second heating member in contact with a surface of the recording material on an opposite side of the surface having formed thereon a toner image, said induction heating means being provided outside said second heating member.

21. A fixing device comprising a heating device which includes a first heating member and a second heating member placed in press contact with one another in a press contact region, wherein said heating device comprises:

an internal heat supply provided in said first heating member;

a heating member to be induction heated, said heating member being provided on an outer surface of said second heating member; and an induction heating section comprising an induction heating coil provided arcuately in a vicinity of said heat generating member outside said second heating member.

22. A heating method of heating a recording material by making the recording material having formed thereon an unfixed toner image pass through a press contact region in which said fixing roller and said pressure roller are in press contact with each other, the method comprising the steps of:

heating said first heating member by an internal heat supply provided in said first heating member; and induction heating, with an induction heating coil provided with an arcuate shape, a portion of a surface of said first heating member adjacent to the arcuate shaped induction coil, which surface is to be in contact with a surface of the recording material on an opposite side of the surface having formed thereon a toner image.

* * * * *